US008730274B2

(12) United States Patent
Chiou et al.

(10) Patent No.: US 8,730,274 B2
(45) Date of Patent: May 20, 2014

(54) BACKLIGHT DIMMING RATIO BASED DYNAMIC KNEE POINT DETERMINATION OF SOFT CLIPPING

(75) Inventors: Ye-long Chiou, Cupertino, CA (US); Louie Lee, Toronto (CA); Futoshi Hayashida, San Jose, CA (US); Vladimir Lachine, Toronto (CA)

(73) Assignee: Synaptics Incorporated, San Jose, CA (US)

( * ) Notice: Subject to any disclaimer, the term of this patent is extended or adjusted under 35 U.S.C. 154(b) by 497 days.

(21) Appl. No.: 13/035,415

(22) Filed: Feb. 25, 2011

(65) Prior Publication Data

US 2012/0218313 A1 Aug. 30, 2012

(51) Int. Cl.
*G09G 5/10* (2006.01)
*G09G 3/36* (2006.01)

(52) U.S. Cl.
USPC ..... 345/690; 345/102

(58) Field of Classification Search
USPC ..... 345/690
See application file for complete search history.

(56) References Cited

U.S. PATENT DOCUMENTS

| | | | | |
|---|---|---|---|---|
| 8,203,522 | B2 * | 6/2012 | Stessen et al. | 345/102 |
| 8,345,038 | B2 * | 1/2013 | Kerofsky | 345/214 |
| 2006/0209003 | A1 * | 9/2006 | Kerofsky | 345/102 |
| 2007/0046793 | A1 | 3/2007 | Sudo | |

OTHER PUBLICATIONS

Tsai, P. et al., "Image Quality Enhancement for Low Backlight TFT-LCD Displays," In ICIP (3), pp. 473-476, IEEE, 2007 (4 pages).
Kerofsky, L. and Daly, S., "Brightness Preservation for LCD Backlight Dimming," Journal of the Society for Information Display, vol. 14, Issue 12, Dec. 2006 (8 pages).
Balasko, H. and Lustica, A., "Advantages of DSP Camera Processing," ELMAR/VipromCom, Sep. 1999 (10 pages).

* cited by examiner

*Primary Examiner* — Alexander S Beck
*Assistant Examiner* — Mihir Rayan
(74) *Attorney, Agent, or Firm* — Osha Liang LLP

(57) ABSTRACT

A liquid crystal display (LCD) system including a liquid crystal (LC) panel; an LC panel controller to send output code values to the LC panel; a backlight to illuminate the LC panel; a backlight controller; and a display controller to control the backlight controller and the LC panel controller, and receive input code values from an image source is presented wherein the LCD system uses a dynamic knee point determination of soft clipping to provide output code values to the LC panel. A method for using an LCD system as above is also provided.

19 Claims, 6 Drawing Sheets

BACKLIGHT DIMMING RATIO BASED DYNAMIC KNEE POINT DETERMINATION OF SOFT CLIPPING

BACKGROUND

1. Field of the Invention

The embodiments described herein relate generally to the field of video display control, and more particularly to the dynamic knee point determination of soft clipping based on backlight dimming ratio.

2. Description of Related Art

Backlight dimming is an extensively used technique in the field of video display control. Energy resource preservation and efficient power consumption management of consumer electronic (CE) devices have led to the incorporation of mechanisms that dim backlights illuminating display images. Backlight dimming may be triggered by certain environmental conditions, or other usage parameters that may allow a video display to function properly without using its maximum power capabilities. In this manner, a reduced power consumption may be realized, leading to longer battery lifetimes (e.g. in the case of laptop computers), less device heating, and overall reduced operation cost of CE devices. One of the challenges faced by designers using backlight dimming is maintaining the quality of the video image displayed under different backlight intensities.

In the case of video displays that make use of liquid crystal (LC) panels, controlling backlight intensity levels may be complemented with control of the LC layer transparency. However, systems currently available commercially provide a simple boost of the transparency of the LC layer. Then, current techniques combine transparency boost with a clipping of pixel transparency once the maximum digital range has been achieved. Thus, commercially available systems present portions of the image having the brightest level attainable, loosing any detail and contrast in those portions, with the consequent loss of image quality. Moreover, the clipping level of the pixel intensity may be fixed for all values of backlight dimming and all contrast conditions of the image being processed. For a video signal streaming multiple frames this may result in a video with varying degree of image quality, which is not desirable.

In order to avoid this problem, some designs provide image-dependent algorithms to regulate the degree of transparency for each pixel according to the particular conditions of an image. This may be achieved by optimizing an image quality factor pixel-to-pixel by comparing the input image with the backlight adjusted image. However, these image-dependent mechanisms involve complex calculations performed for every frame being transferred to the display system. The result is a limited time response for image adjustment, which is not desirable for a video transmission. Furthermore, such configurations need to implement complex algorithms using sophisticated memories and processor chips.

What is needed is a method and an apparatus to compensate for backlight dimming in video displays and maintain the quality of the image being displayed. Furthermore, it is desirable that the method be simple, fast to implement, and dynamically adjustable to different backlight levels.

SUMMARY

A liquid crystal display (LCD) system according to some embodiments disclosed herein may include a liquid crystal (LC) panel; an LC panel controller to send output code values to the LC panel; a backlight to illuminate the LC panel; a backlight controller; and a display controller to control the backlight controller and the LC panel controller, and receive input code values from an image source. Further, the LCD system may use a dynamic knee point determination of soft clipping to provide output code values to the LC panel. A method for using an LCD system to provide an input to output code value conversion including the step of using a backlight dimming ratio to provide a dynamic knee point for soft clipping the input to output code value conversion is also provided according to embodiments disclosed herein.

These and other embodiments of the present invention are further described below with reference to the following figures.

BRIEF DESCRIPTION OF THE DRAWINGS

In the figures, elements having the same reference number have the same or similar functions.

DETAILED DESCRIPTION OF THE DRAWINGS

Backlight dimming and pixel compensation techniques are used across the board by the video display industry to reduce power consumption in consumer electronics devices. One of the commonly used strategies for pixel compensation in view of backlight dimming is that of 'hard clipping' pixel values beyond a certain input level. By 'hard clipping' it is meant that all pixels associated to an input value beyond a certain 'reference level' will have a single output value in the video display. Typically, the output clipping value corresponds to the highest value available in the output digital range of the video display device. The result is the loss of any features or details that may appear in the portion of the image corresponding to the pixels that have been 'hard clipped.' Image quality may drastically deteriorate in these circumstances, depending on the 'hard clip' value chosen.

Figure 1:
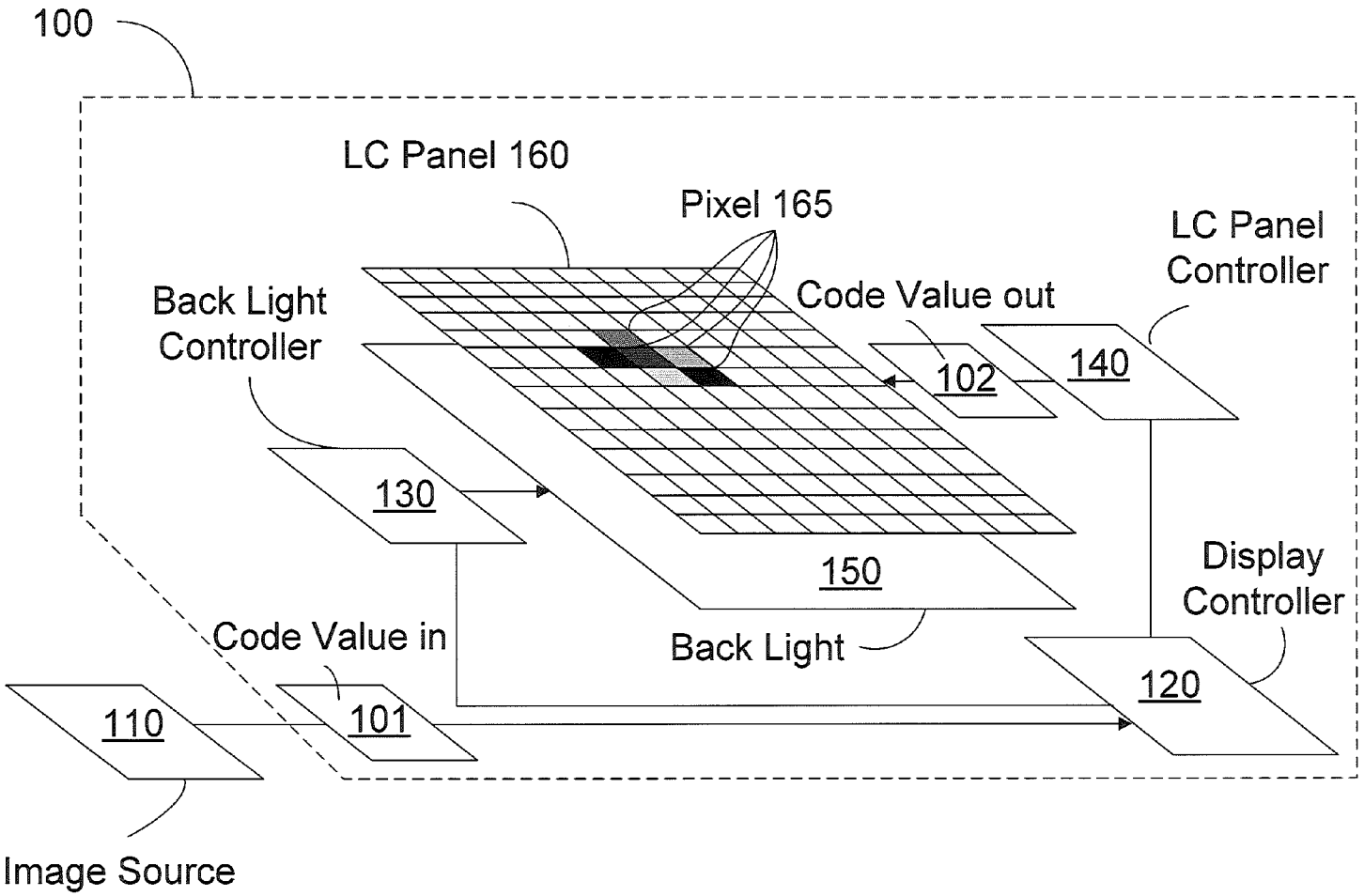
FIG. 1 shows an image source having input code value and an LCD system having output code value as described in the present specification.

FIG. 1 shows image source 110 providing input code values 101 to LCD system 100 having output code values 102 as described in the present specification. Image source 110 provides an image that may include a set of input code values 101, to be processed and displayed by LCD system 100. Input code values 101 may include a set of values associated with each pixel in a 2-dimensional image. The 2-dimensional image may be a frame in a video data stream transmitted from image source 110 to LCD system 100. Image source 110 may be a video camera, a remote site on the internet, a computer, or an application running on a computer, such as a video game or a movie, according to some embodiments.

Input code values 101 may correspond to an image being transferred from source 110 to be displayed by LCD system 100. LCD system 100 may include display controller 120, backlight controller 130, LC panel controller 140, back light 150, and LC panel 160. Furthermore, LC panel 160 may include a 2-dimensional array of pixels 165. In the embodiments such as depicted in FIG. 1, controller 120 may be coupled to backlight controller 130, to adjust the intensity level of backlight 150. Also, controller 120 may be coupled to LC controller 140, which provides a set of output code values 102 to pixels 165 in LC panel 160. Input code values 101 and output code values 102 may be a set of digital values representing voltages provided to pixels 165. For example, in some embodiments each of the voltages represented by code values 101 and 102 may be associated to a certain optical transmittance or 'transparency' for a given pixel 165.

In the embodiment of LCD system 100 depicted in FIG. 1, pixel 165 may include a transistor having an LC layer placed between two terminals. The voltage values included in output code 102 may represent a value of the electric field established between the two terminals in the transistor, across the LC layer. The transparency of the LC layer may be controlled by the value of the electric field according to the rotation of the polarization of light going through the LC layer from back light 150 to the viewer. Thus, a certain degree of transparency may be provided by the LC material according to the voltage value established between the terminals of a transistor in each pixel 165. Some embodiments of LCD system 100 may use three digital values for each pixel 165 in input code set 101 and output code set 102. For example, each of the digital values associated with a single pixel 165 may correspond to a color component for the pixel, such as in a Red-Green-Blue (RGB) color configuration. Some embodiments may use three digital values associated to a color code encoded in a YCbCr configuration. Thus, some embodiments of LCD system 100 as depicted in FIG. 1 may control the transparency of pixel 165 independently for each of three color components, such as RGB or YCbCr.

In some embodiments, the intensity of the light transmitted through each pixel 165 is a function of the backlight intensity and pixel transparency. Different light intensities transmitted by each pixel 165 in panel 160 are shown in FIG. 1 as different tonalities of gray. Such may be the case for an embodiment having a black and white image being displayed by LCD system 100. Some embodiments of LCD system 100 as described above may use a combination of intensities in a three color component image, to display a full color gamut picture or frame.

Based on a requirement to dim the intensity of back light 150 in LCD system 100, controllers 120 and 140 may adjust code values 102 from code values 101. The result may be an image having the same or similar pixel intensity as that of image source 110. Thus, image quality from image source 110 may be maintained in LCD 100. In some embodiments, the pixel intensity produced in LCD system 100 may be different. Some embodiments may provide code values 102 so that quality parameters other than intensity may be preserved or improved in LCD 100 relative to image source 110, such as contrast.

Figure 2:
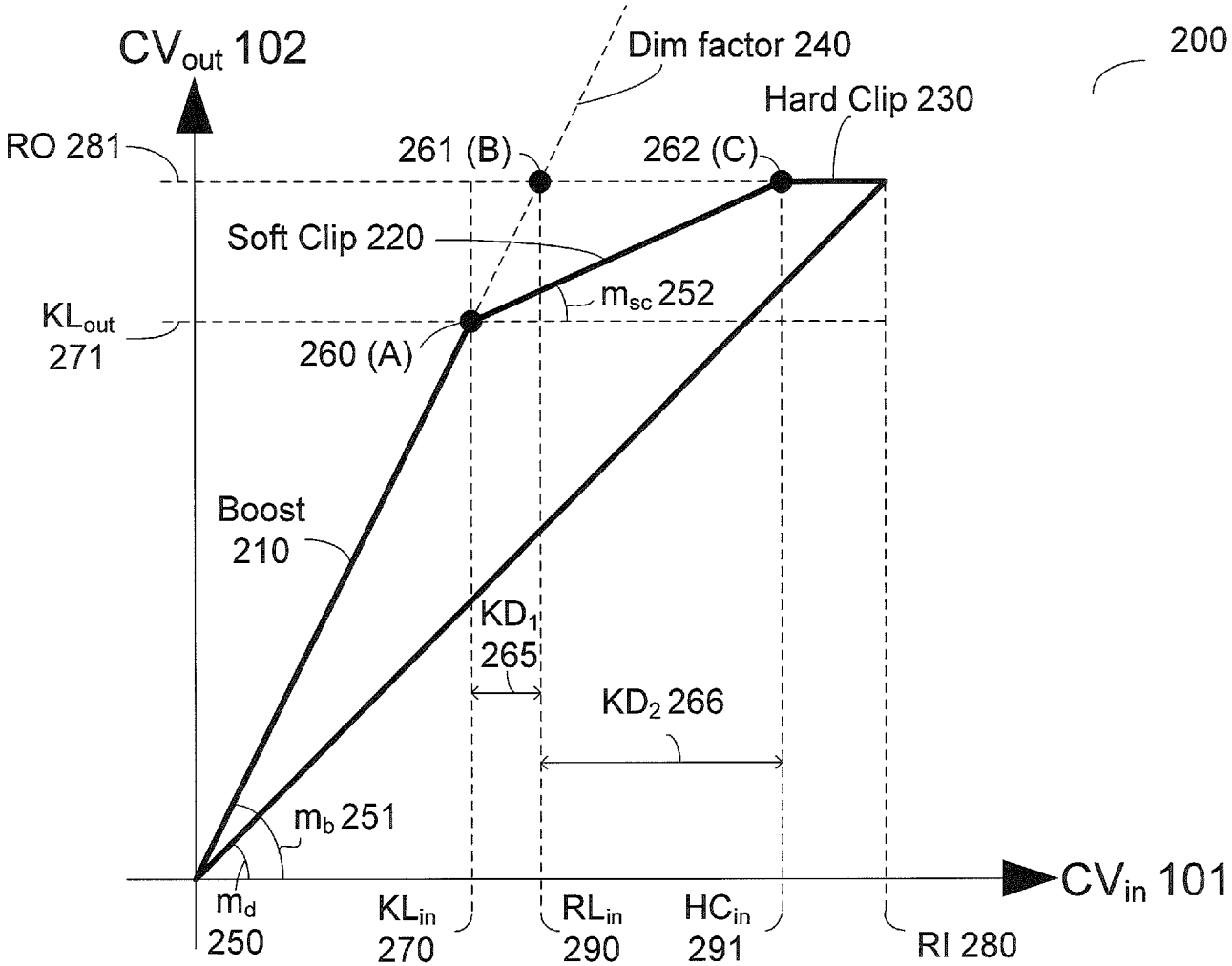
FIG. 2 shows a code conversion chart, according to some embodiments.

FIG. 2 shows code conversion chart 200 according to some embodiments. Chart 200 may be used by LC panel controller 140 for conversion of input code values ($CV_{in}$) 101 to output code values ($CV_{out}$) 102. Chart 200 may also be provided to LC controller 140 by controller 120, according to some embodiments. Further, some elements of chart 200 may be provided to LC controller 140 by controller 120, and some elements of chart 200 may be obtained within LC controller 140. Input code values ($CV_{in}$) 101 and output code values ($CV_{out}$) 102 may be digital values having a range RI (input), and a range RO (output). For example, for an 8-bit data string carrying each of $CV_{in}$ and $CV_{out}$ values, input digital range (RI 280), and output digital range (RO 281) may be equal to 255. Digital ranges 280 and 281 indicate the power resolution of pixels in image source 110 (RI 280) and pixels 165 in LCD system 100 (RO 281). RI 280 and RO 281 may be the same according to some embodiments. Digital ranges 280 and 281 may be different in some embodiments where the technical specifications of image source 110 and LCD system 100 may differ from each other.

Under operation conditions such that no backlight dimming is introduced in LCD 100, the curve of $CV_{out}$ values 102 provided by LC controller 140 from $CV_{in}$ values 101 may follow a straight line having slope $m_d$ 250. According to FIG. 2, the value of $m_d$ is given by the ratio RO/RI. From the above discussion, $m_d$ 250 may be equal to one (1) when RO 281 is equal to RI 280.

In some embodiments, image source 110 may provide $CV_{in}$ 101 corresponding to a fully illuminated backlight. Controller 120 in LCD system 100 may then provide a dimming ratio (DR) to backlight 150 to reduce power consumption by LCD system 100. Thus, when DR=1, there is no backlight dimming. When DR<1, there is a backlight dimming. According to some embodiments, it may be desired that the pixel brightness (PB) between image source 110 and LC panel 160 be maintained constant. The value of PB is generally proportional to the brightness of backlight source 150 (BL), and a pixel code value CV. Thus, for image source 110, pixel brightness $PB_{110}$ is given by $$PB_{110}=CV_{in}\cdot BL. \tag{1}$$

And for LCD 100 pixel brightness $PB_{100}$ is $$PB_{100}=CV_{out}\cdot BL\cdot DR. \tag{2}$$

DR may be less than one (1), so according to Eqs. (1) and (2), to maintain $PB_{100}$~$PB_{110}$ for at least a portion of values $CV_{in}$ 101 in some embodiments chart 200 may include boost portion 210. As illustrated in FIG. 2, boost 210 is such that the slope $m_b$ for $CV_{out}$ as a function of $CV_{in}$ is greater than 1, compensating for the reduced BL given by DR. According to some embodiments consistent with FIG. 2, $m_b$ 251=(1/DR) so that $PB_{100}$ be similar to $PB_{110}$.

$$\begin{aligned} CV_{out} &= m_b\cdot CV_{in};\ 1\le m_b=(1/DR);\ 0\le CV_{in}\le KL_{in}; \\ PB_{100} &= CV_{out}\cdot BL\cdot DR \\ &= m_b\cdot CV_{in}\cdot BL\cdot DR \\ &= CV_{in}\cdot BL \\ &= PB_{110}. \end{aligned} \tag{3}$$

To compensate for a reduced backlight intensity LC panel controller 140 may provide 'boost' 210 to $CV_{out}$ 102 as a function of $CV_{in}$ 101 (cf. Eq. (3)). According to some embodiments as depicted in FIG. 2, boost 210 may correspond to dim factor curve 240, and include a linear relation between $CV_{in}$ 101 and $CV_{out}$ 102 having a slope ($m_b$) 251. In some embodiments $m_b$ 251 is greater than one ($1<R_O/R_I$) so that $CV_{in}<CV_{out}$ for at least a portion of range 280. This may result in the light intensity through every pixel 165 in LCD 100 to be the same as for image source 110.

Some embodiments such as depicted in FIG. 2 may provide boost 210 for $CV_{out}$ 102 up to 'knee point' (A) 260. As depicted in FIG. 2, point A 260 may occur for a $CV_{in}$ value equal to 'knee left_in' ($KL_{in}$) 270. Likewise, point A 260 has a $CV_{out}$ value equal to 'knee left_out' ($KL_{out}$) 271 which may be given by Eq. (3)

$$KL_{out} = \left(\frac{1}{DR}\right) \cdot KL_{in}. \tag{4}$$

In some embodiments such as depicted in FIG. 2, $KL_{out}$ 271<RO 281. Thus, $CV_{out}$ values 102 are below digital range 281 of LC panel 160, and pixels 165 are able to display the image encoded in values 101, up to $CV_{in}$ values less than or equal to $KL_{in}$ 270 with equivalent pixel brightness. From point A 260 to point C 262 in FIG. 2, LC controller 140 may provide a linear relation between $CV_{out}$ 102 values and $CV_{in}$ 101 values at a slope, $m_{sc}$ 252. The portion of conversion chart 200 between points A 260 and C 262 may be referred as 'soft clip' 220. Thus, according to the embodiment depicted in FIG. 2, in 'soft clip' portion 220 the following is satisfied $$CV_{out}=m_{sc}\cdot(CV_{in}-KL_{in})+ \tag{5}$$

Note that in the embodiment depicted in FIG. 2, slope $m_{sc}$ 252 in 'soft clip' 220 satisfies: $m_{sc}<m_d/DR$. According to FIG. 2, point C 262 corresponds to a $CV_{out}$ value 102 that is at RO 281 of the digital output in LC panel 160. This value is reached for a $CV_{in}$ 101 value given by $HC_{in}$ 291; note that $HC_{in}$<RI 280. Point C 262 may be referred to as 'hard clip' point in embodiments such as depicted in FIG. 2. For $CV_{in}$ values greater than $HC_{in}$ 291, the $CV_{out}$ value is 'hard clipped' at the maximum range 281. In some embodiments this portion of chart 200 may be referred to as 'hard clip' portion 230.

By having knee point 260 and 'soft clip' portion 220 as depicted in FIG. 2, hard clip point 262 moves from hard clip reference point B 261 to hard clip point C 262. Hard clip reference point B 261 has $CV_{in}$ value $RL_{in}$ 290, and hard clip point C 262 has $CV_{in}$ value $HC_{in}$ 291, with $RL_{in}<HC_{in}$. Thus, embodiments such as illustrated in FIG. 2 provide an image in LCD 100 where 'hard clip' portion 230 is substantially reduced compared to a chart having a simple 'boost' and hard clip portion.

FIG. 2 also shows that the portion of $CV_{in}$ 101 values between $RL_{in}$ 290 and $HC_{in}$ 291, spanning knee distance ($KD_2$) 266 corresponds to pixel values that are not hard clipped by LCD display 100. Thus, the image content for pixels having code values included within range $KD_2$ 266 is differentiable. That is, every value $CV_{in}$ 101 within range $KD_2$ 266 has a unique corresponding value $CV_{out}$ 102. Thus, for any two different values $CV_{in}$ 101 within range $KD_2$ 266, the corresponding output values $CV_{out}$ 102 are different. Thus the pixel brightness in LC panel 160 is distinguishable between one value and the other, as it is in image source 110 to LCD 100.

In some embodiments slope 252 may be lower than slope 250 ($m_{sc}<m_d$), resulting in compression of the image from image source 110 to LCD 100, at least in the portions within range $KD_2$ 266. This may reduce the level of contrast of the image in LCD 100, but still allow features within range $KD_2$ 266 to be displayed in LCD 100, as opposed to the case with hard clip reference point B 261. With soft clipping portion 220, pixels in LC panel 160 extend their differentiability range to $KD_2$ 266. Having an extended differentiability range, picture quality factors from image 110, such as contrast, may be preserved.

Further embodiments of code conversion 200 according to FIG. 2 and consistent with the above description may be included in the following mathematical expression ($m_d$=1)

$$CV_{out} = \begin{cases} \left(\frac{1}{DR}\right)\cdot CV_{in}, & 0 \le CV_{in} \le KL_{in} \\ m_{sc}\cdot(CV_{in}-KL_{in})+KL_{out}, & KL_{in} < CV_{in} \le HC_{in} \\ \text{Range_out}(RO), & HC_{in} < CV_{in} \le \text{Range_in}(RI) \end{cases} \tag{6}$$

Once dim factor 240 is established, the choice of $m_{sc}$ 252, the location of point A 260, and the location of hard clip point C 262 may vary according to different specifications and applications. Different choices may be included in embodiments of code conversion 200 as described above in relation to FIG. 2. The criteria used to select the precise shape of conversion curve 200 may vary according to the image quality desired and the specifications of LCD 100.

Figure 3:
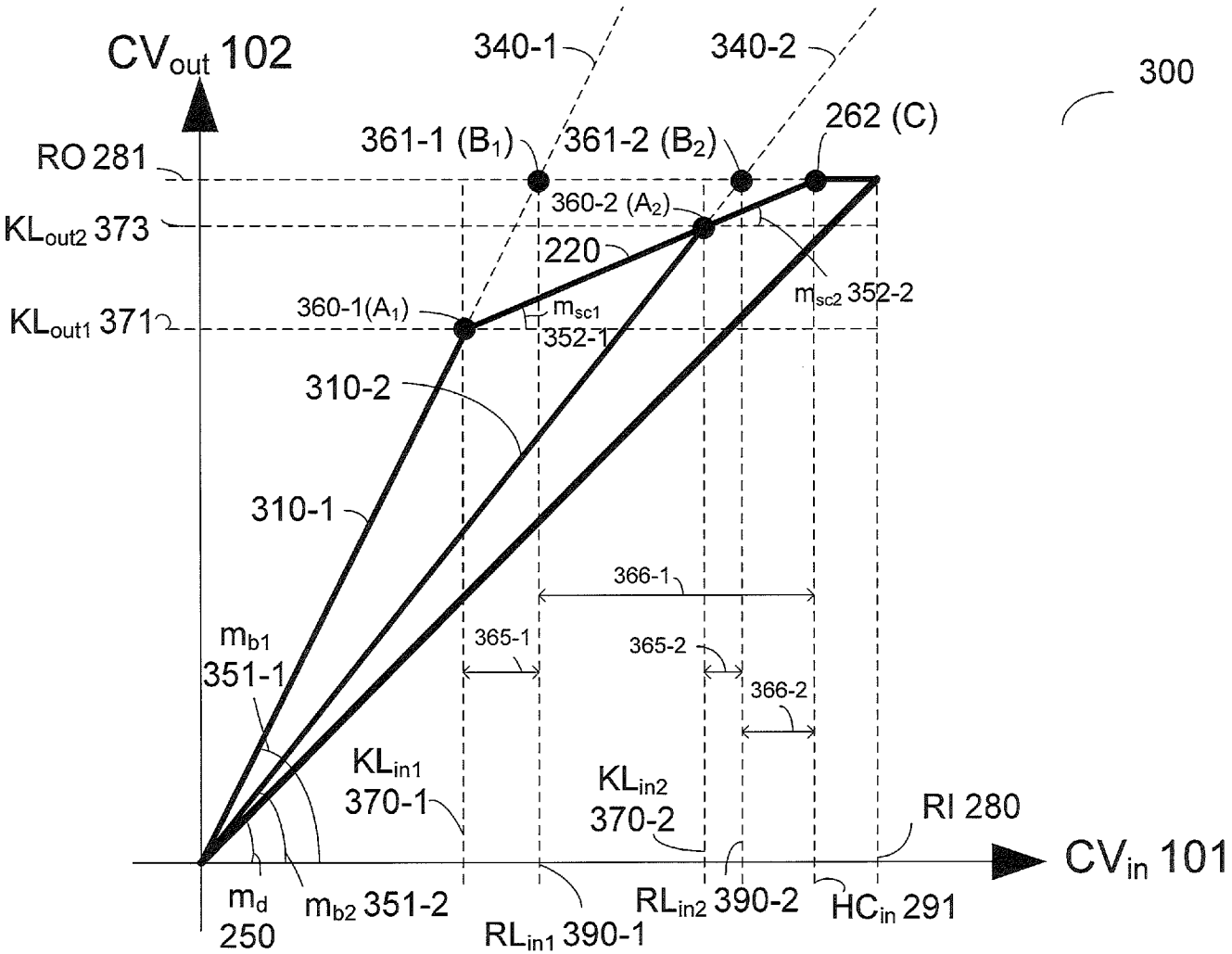
FIG. 3 shows a code conversion chart, according to some embodiments.

FIG. 3 shows code conversion chart 300, according to some embodiments. Chart 300 may include conversion curves for dim factors 340-1 and 340-2, resulting from dim ratios $DR_1$ and $DR_2$, respectively. As a result, boost portions 310-1 and 310-2 having slopes $m_{b1}$ 351-1 (boost 310-1) and $m_{b2}$ 351-2 (boost 310-2) may be included in chart 300. Hard clip reference points $B_1$ 361-1 and $B_2$ 361-2 may occur at different $CV_{in}$ values $RL_{in1}$ 390-1 and $RL_{in2}$ 390-2, according to some embodiments consistent with FIG. 3. Also, knee point $A_1$ 360-1 for boost 310-1 may occur at $CV_{in}$ value $KL_{in1}$ 370-1 and knee point $A_2$ 360-2 for boost 310-2 may occur at $CV_{in}$ value $KL_{in2}$ 370-2. In some embodiments, values for $KL_{in1}$ 370-1 and $KL_{in2}$ 370-2 may be different from each other, as shown in FIG. 3. Some embodiments may include $KL_{in1}$ 370-1 and $KL_{in2}$ 370-2 values being equal to one another.

Some embodiments consistent with FIG. 3 have soft clip portion 220 joining knee points $A_1$ 360-1 and $A_2$ 360-2 with hard clip point C 262. The slope of portion 220 at point $A_1$ is $m_{sc1}$ 352-1, and at point $A_2$ is $m_{sc2}$ 352-2. Some embodiments of chart 300 such as depicted in FIG. 3 may have $m_{sc1}=m_{sc2}$. Thus, the same hard clip point C 262 may result for dim factors 340-1 and 340-2, at $CV_{in}$ value $HC_{in}$ 291. Knee distances 365-1 and 366-1 may result for point $B_1$, and knee distances 365-2 and 366-2 may result for point $B_2$, according to embodiments consistent with FIG. 3.

Further embodiments of chart 300 according to FIG. 3 and consistent with the above description may be included in the following mathematical expression. For dim factor 340-1 having dimming ratio $DR_1$ ($m_d$=1):

$$CV_{out} = \begin{cases} \left(\frac{1}{DR_1}\right)\cdot CV_{in}, & 0 \le CV_{in} \le KL_{in1} \\ m_{sc1}\cdot(CV_{in}-KL_{in1})+KL_{out1}, & KL_{in1} < CV_{in} \le HC_{in1} \\ \text{Range_out}(RO), & HC_{in1} < CV_{in} \le \text{Range_in}(RI). \end{cases} \tag{7}$$

And for dim factor 340-2 having dimming ratio $DR_2$ ($m_d$=1)

$$CV_{out} = \begin{cases} \left(\frac{1}{DR_2}\right)\cdot CV_{in}, & 0 \le CV_{in} \le KL_{in2} \\ m_{sc2}\cdot(CV_{in}-KL_{in2})+KL_{out2}, & KL_{in2} < CV_{in} \le HC_{in2} \\ \text{Range_out}(RO), & HC_{in2} < CV_{in} \le \text{Range_in}(RI). \end{cases} \tag{8}$$

Where $m_{sc2}$ may be equal to $m_{sc1}$ and $HC_{in1}$ may be equal to $HC_{in2}$. In some embodiments consistent with the description given for FIG. 3, a plurality of dim factors 340-1 to **340-*n* may be included in conversion chart 300, where 'n' may be greater than two (2). Different dim ratios may be included leading to a plurality of knee points for each dim factor. The plurality of knee points may be included along the same soft clip portion 220, having slope $m_{sc}$ 352, and having hard clip point C 262, in some embodiments consistent with FIG. 3**.

Figure 4:
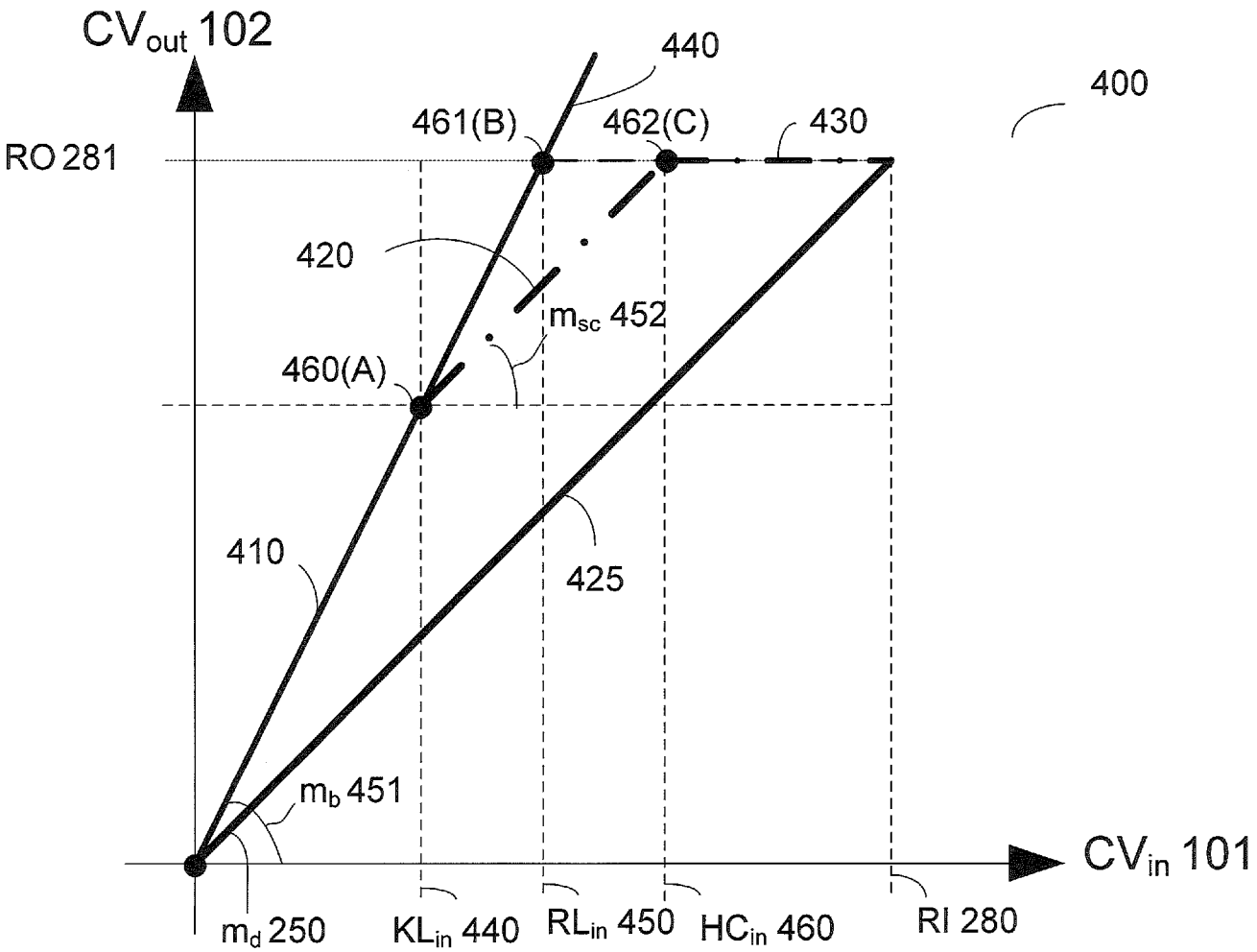
FIG. 4 shows a code conversion chart, according to some embodiments.

FIG. 4 shows code conversion chart 400. Dim factor 440 corresponds to a dim ratio of 50% (DR=0.5.) Thus, reference point 461 (B) occurs at $RL_{in}$=½RI. The setting of knee point (A) with $KL_{in}$ 440 equal or greater than ½ RI has no effect on hard clip portion to the right of point 461 (B). If conversion chart 425 is chosen with knee point (A) set at $KL_{in}$=0, $CV_{out}$ will provide half (½) the brightness for all pixels with $CV_{in}$≤½ RI. Thus, setting the knee point at $KL_{in}$=0 results in reduced brightness and may not be desirable.

If knee point 460 (A) is set as $KL_{in}$ 440 (cf. FIG. 4), $CV_{out}$ code conversion chart 400 follows boost 410, soft portion 420, and hard clip portion 430. Accordingly:

$$CV_{out} = \begin{cases} \left(\frac{1}{DR}\right)\cdot CV_{in} = 2\cdot CV_{in}, & 0 \le CV_{in} \le KL_{in} \\ 2\cdot KL_{in} + 1\cdot(CV_{in} - KL_{in}), & KL_{in} < CV_{in} \le HC_{in} \\ RO, & HC_{in} < CV_{in} \le RI \end{cases} \tag{9}$$

Code conversion chart 400, having portions 410, 420, and 430 according to Eq. (9), shows better results than line 425 or line 440 with hard clip reference point 461 (B). Conversion curve 400 preserves brightness level for $CV_{in}$ between [0, $KL_{in}$ 440] and moves hard clip point from 461(B) to 462(C).

Setting knee point 460 (A) at about $KL_{in}$=0 or too far to the left of hard clip reference point 461 (B) results in reduced brightness. Also, setting knee point 460 (A) to the right of hard clip reference point 461 (B) has no effect in clipped portion 430. Thus, knee point 460 (A) may be set in a vicinity to the left of hard clip reference point 461 (B). Since hard clip reference point 461 (B) changes according to image frames fed by source 110, knee point 460 (A) needs to be dynamically adjusted to obtain the best image quality. In some embodiments, knee point 460 (A) may be determined as a function of hard clip reference point 461 (B). Hard clip reference point 461 (B) may be determined by the Dimming Ratio (DR). Thus, in some embodiments knee point 460 (A) may be dynamically determined by the Dimming Ratio (DR).

Figure 5:
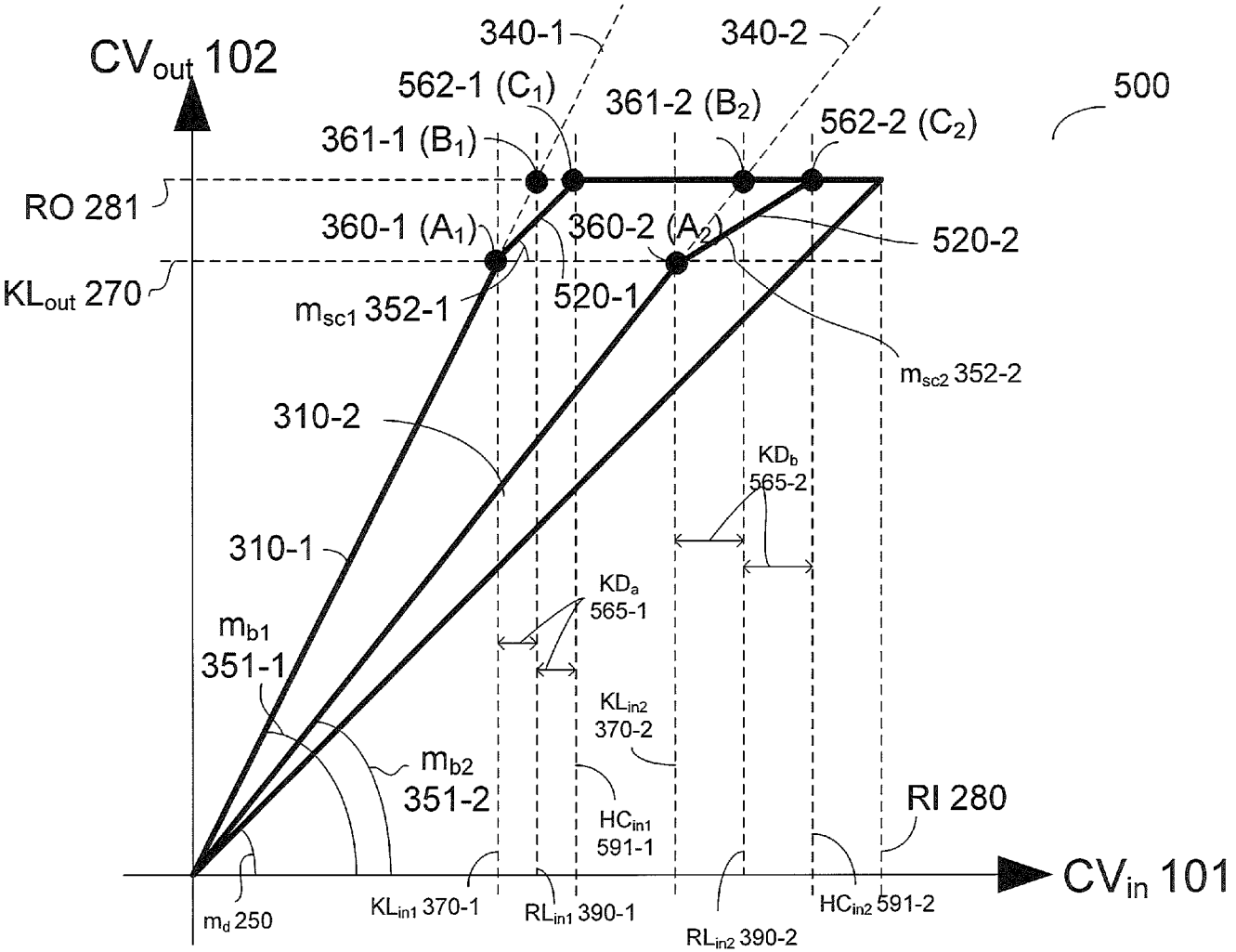
FIG. 5 shows a code conversion chart, according to some embodiments.

FIG. 5 shows code conversion chart 500, according to some embodiments. Similar to the embodiment illustrated in FIG. 3, chart 500 may include conversion data for a plurality of dim factors. For example, FIG. 5 illustrates dim factors 340-1 and 340-2, associated to boost 310-1 and 310-2 having slopes $m_{b1}$ 351-1 and $m_{b2}$ 351-2, and knee points $A_1$ 360-1 and $A_2$ 360-2, respectively. Dim factors 340-1 and 340-2 may be related to dimming ratios $DR_1$ and $DR_2$, respectively. Hard clip reference points $B_1$ 361-1 and $B_2$ 361-2 having $CV_{in}$ values $RL_{in1}$ 390-1 and $RL_{in2}$ 390-2 may be as illustrated in FIG. 5. In embodiments such as depicted in FIG. 5, $CV_{out}$ value $KL_{out}$ 270 may be the same for knee point $A_1$ 360-1 and for knee point $A_2$ 360-2. Some embodiments may include different knee levels for $CV_{out}$ at knee point 360-1 and at knee point $A_2$ 360-2. Soft clip portions 520-1 and 520-2 join knee points $A_1$ 360-1 and $A_2$ 360-2 with hard clip point 562-1 ($C_1$) and hard clip point 562-2 ($C_2$), respectively. Embodiments consistent with FIG. 5 may include soft portions 520-1 and 520-2 having slopes $m_{sc1}$ 352-1 and $m_{sc2}$ 352-2, respectively. As illustrated in FIG. 5, slopes $m_{sc1}$ 352-1 and $m_{sc2}$ 352-2 may be different from one another. Further, according to FIG. 5, slope $m_{sc1}$ 352-1 may be greater than $m_{sc2}$ 352-2 where $RL_{in1}$ 390-1 is smaller than $RL_{in2}$ 390-2. That is, some embodiments consistent with FIG. 5 are such that $m_{sc1}$ $m_{sc2}$ with $RL_{in1}<RL_{in2}$. As a result, hard clip points $C_1$ 562-1 and $C_2$ 562-2 may occur at different $CV_{in}$ values, $HC_{in1}$ 591-1 and $HC_{in2}$ 591-2, respectively. For example, in FIG. 5, $HC_{in1}<HC_{in2}$.

In embodiments of chart 500 consistent with FIG. 5 knee distances 565-1 ($KD_a$) may be the same for either side of hard clip reference point $B_1$ (to the left and right of $RL_{in1}$ 390-1). The same may be true for knee distances 565-2 ($KD_b$), to the left and right of $RL_{in2}$ 390-2. Furthermore, knee distances 565-1 and 565-2 may be proportionally related to $RL_{1in1}$ 390-1 and $RL_{in2}$ 390-2. Thus, for example, the following may be satisfied: $KD_a=(P_a/100)\times RL_{in1}$, and $KD_b=(P_b/100)\times RL_{in2}$ where $P_a$ and $P_b$ may be percent numbers between 0 and 100. In some embodiments, the values of $P_a$ and $P_b$ may be the same, independently of the value used for dim factor 340-1 or 340-2.

Further embodiments of code conversion 500 in LC controller 140 according to FIG. 5 and consistent with the above description may be included in the following mathematical expression. For dim factor 340-1 having dimming ratio $DR_1$ ($m_d$=1)

$$CV_{out} = \begin{cases} \left(\frac{1}{DR_1}\right)\cdot CV_{in}, & 0 \le CV_{in} \le KL_{in1} \\ m_{sc1}\cdot(CV_{in} - KL_{in1}) + KL_{out1}, & KL_{in1} < CV_{in} \le HC_{in1} \\ \text{Range_out}(RO), & HC_{in1} < CV_{in} \le \text{Range_in}(RI). \end{cases} \tag{10}$$

And for dim factor 340-2 having dimming ratio $DR_2$ ($m_d$=1)

$$CV_{out} = \begin{cases} \left(\frac{1}{DR_2}\right)\cdot CV_{in}, & 0 \le CV_{in} \le KL_{in2} \\ m_{sc2}\cdot(CV_{in} - KL_{in2}) + KL_{out2}, & KL_{in2} < CV_{in} \le HC_{in2} \\ \text{Range_out}(RO), & HC_{in2} < CV_{in} \le \text{Range_in}(RI). \end{cases} \tag{11}$$

Where $KL_{out1}$ may be equal to $KL_{out2}$, and $m_{sc1}$ may be different from $m_{sc2}$. In some embodiments a plurality of dim factors may be included in conversion chart 500 (being more than two, as shown in FIG. 5). Different dim ratios may be included leading to a plurality of knee points for each dim factor. The plurality of knee points may have the same $CV_{out}$ level, $KL_{out}$, different soft clip slopes, and different hard clip points, according to embodiments consistent with FIG. 5.

From FIGS. 3-5 criteria for selecting soft clipping point $KL_{in}$ 270 to find knee point 260 (A, cf. FIG. 2) may be established:

1. Some pixel brightness may be sacrificed for $CV_{in}$ 101 values ranging from $RL_{in}$ 290 to $HC_{in}$ 291.
2. While pixel brightness is reduced, the differentiability of pixel brightness for $CV_{in}$ 101 values ranging from $RL_{in}$ 290 to $HC_{in}$ 291 is maintained.
3. If $KL_{in}$ is set to 0, pixel brightness is reduced. In this case, the soft clipping portion is the straight line with slope $m_d$ 250. (cf. FIG. 2).
4. If $KL_{in}$ is set higher than $RL_{in}$ 290 (hard clip reference point 261 (B)) no effect on pixel brightness is obtained either. No soft clipping portion 220 is included in chart 200 (cf. FIG. 2).

5. If $KL_{in}$ is in between '0' and $RL_{in}$ 290 (hard clip reference point 261 (B)), then soft clipping portion 220 is included in chart 200 (cf. FIG. 2).

Figure 6:
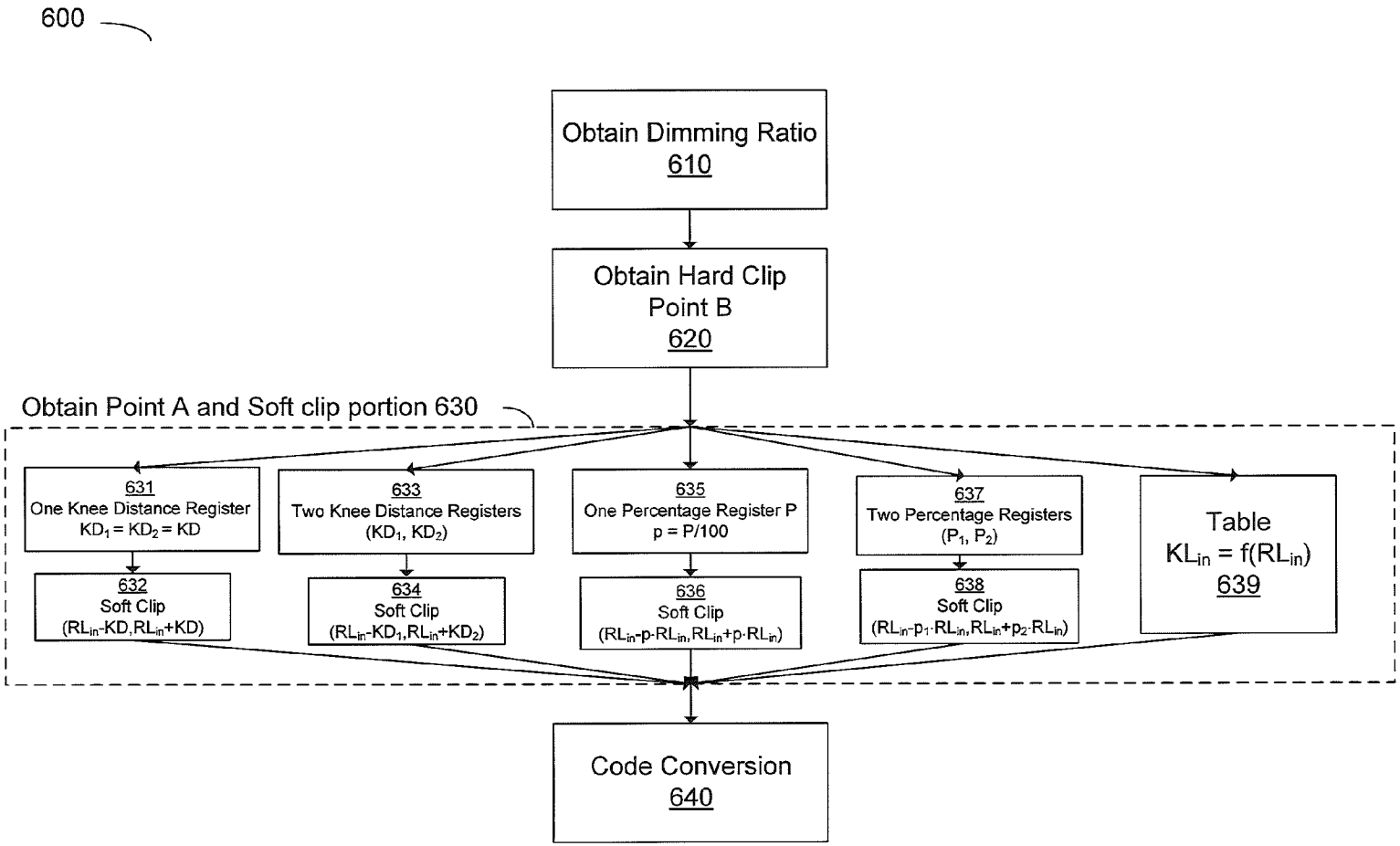
FIG. 6 shows a flow chart for a method to obtain a knee point and a soft clip portion for a code conversion chart, according to some embodiments.

FIG. 6 shows flow chart 600 for a method to obtain knee point 260 and soft clip portion 220 for input code value to output code value conversion according to some embodiments. In some embodiments, the steps illustrated in FIG. 6 may be performed by display controller 120. The steps in FIG. 6 may also be performed by LC panel controller 140, according to some embodiments consistent with FIG. 6. Also consistent with FIG. 6, some of the steps therein may be performed by display controller 120, and some of the steps may be performed by LC panel controller 140. Furthermore, some of the steps illustrated in FIG. 6 may be performed by backlight controller 130, which in turn may be controlled by display controller 120.

Step 610 in FIG. 6 includes obtaining a value for a dimming ratio DR to be applied in LCD 100. The dimming ratio DR is determined by the Display Controller 120. The Display Controller 120 calculates the brightness value of Code Value 101 from Image Source 110 and generates a dimming ratio DR to Back Light Controller 130. There are various algorithms to determine the best dimming ratio DR for Image Source 110. Once determined, the dimming ratio not only sends to Back Light Controller 130 to control the Back Light 150 but also send to the Obtain Dimming Ratio 610.

Having established a value for DR, step 620 includes obtaining hard clip reference point B in the conversion chart. Hard clip reference point B may be, as described above in relation to FIG. 2, the point at which boost portion 210 (cf. FIG. 2) may reach the maximum output range 281 for LC panel 160, without soft clipping. In relation to the embodiment depicted in FIG. 2, hard clip reference point B may be calculated in step 620 by the following expression ($m_d$=1)

$$RL_{in} = \left(\frac{DR}{1}\right) \cdot \text{Range_out}(RO). \tag{12}$$

Where the coordinates of hard clip reference point B may be given as ($RL_{in}$, RO) in embodiments consistent with FIG. 2 above. Using the value of RLin obtained in step 620 as a reference value, step 630 may include the obtaining of knee point A 260 (cf. FIG. 2) and soft clip portion 220. According to embodiments consistent with FIG. 6, obtaining knee point A 260 may include step 631. In step 631 one knee distance (KD) register may be used to store values $KD_1$=$KD_2$=KD (cf. FIG. 2). According to embodiments consistent with FIG. 2, point A in step 631 may be assigned coordinates ($KL_{in}$, $KL_{out}$) given by the following expressions ($m_d$=1)

$$KL_{in} = RL_{in} - KD, \tag{13}$$

and $$KL_{out} = \left(\frac{1}{DR}\right) \cdot KL_{in} = \left(\frac{1}{DR}\right) \cdot (RL_{in} - KD). \tag{14}$$

In step 632 soft clip portion 220 may be obtained by joining points A 260 and C 262 by a straight line segment, according to embodiments consistent with FIG. 2. The precise location of point C may be found with coordinates ($RL_{in}$+KD, RO).

According to embodiments consistent with FIG. 6, obtaining knee point A 260 may include step 633. In step 633 two knee distance registers may be used to store values $KD_1$ and $KD_2$ separately (cf. FIG. 2). According to embodiments consistent with FIG. 2, point A in step 631 may be assigned coordinates ($KL_{in}$, $KL_{out}$) given by the following expressions ($m_d$=1)

$$KL_{in} = RL_{in} - KD_1, \tag{15}$$

and $$KL_{out} = \left(\frac{1}{DR}\right) \cdot KL_{in} = \left(\frac{1}{DR}\right) \cdot (RL_{in} - KD_1) \tag{16}$$

In step 634 soft clip portion 220 may be established by joining points A 260 and C 262 by a straight line segment, according to embodiments consistent with FIG. 2. The precise location of point C may be found with coordinates ($RL_{in}$+$KD_2$, RO).

According to embodiments consistent with FIG. 6, obtaining knee point A 260 may include step 635. In step 635 one percentage register may be used to store a value P that may be a percentage (i.e. a number between 0 and 100, expressed in %). According to embodiments consistent with FIG. 2, point A in step 635 may be assigned coordinates ($KL_{in}$, $KL_{out}$) given by the following expressions ($m_d$=1)

$$KL_{in} = RL_{in}\left[1 - \left(\frac{P}{100}\right)\right], \tag{17}$$

and $$KL_{out} = \left(\frac{1}{DR}\right) \cdot KL_{in} = \left(\frac{1}{DR}\right) \cdot RL_{in}\left[1 - \left(\frac{P}{100}\right)\right]. \tag{18}$$

In step 636 soft clip portion 220 may be established by joining points A 260 and C 262 by a straight line segment, according to embodiments consistent with FIG. 2. Obtaining a soft clip portion in step 636 may be established by joining points $A_1$ 360-1 and $C_1$ 562-1, or points $A_2$ 360-2 and $C_2$ 562-2, according to embodiments consistent with FIG. 5. In step 636, the precise location of point C may be found with coordinates ($RL_{in}$+(P/100)×$RL_{in}$, RO).

According to embodiments consistent with FIG. 6, obtaining knee point A 260 may include step 637. In step 637 two percentage registers may be used to store values $P_1$ and $P_2$ that may be percentages (i.e. numbers between 0 and 100, expressed in %). According to embodiments consistent with FIG. 2, point A in step 637 may be assigned coordinates ($KL_{in}$, $KL_{out}$) given by the following expressions ($m_d$=1)

$$KL_{in} = RL_{in}\left[1 - \left(\frac{P_1}{100}\right)\right], \tag{19}$$

and $$KL_{out} = \left(\frac{1}{DR}\right) \cdot KL_{in} = \left(\frac{1}{DR}\right) \cdot RL_{in}\left[1 - \left(\frac{P_1}{100}\right)\right]. \tag{20}$$

In step 638, soft clip portion 220 may be established by joining points A 260 and C 262 by a straight line segment, according to embodiments consistent with FIG. 2. Obtaining a soft clip portion in step 638 may be established by joining points $A_1$ 360-1 and $C_1$ 562-1, or points $A_2$ 360-2 and $C_2$ 562-2, according to embodiments consistent with FIG. 5. In step 638, the precise location of point C may be found with coordinates ($RL_{in}$+($P_2$/100)×$RL_{in}$, RO).

According to embodiments consistent with FIG. 6, obtaining knee point A 260 may include step 639. In step 639, a value for $KD_1$ (cf. FIG. 2) may be obtained from a list or a lookup table, using the value $RL_{in}$ obtained in step 620 (cf. Eq. 12). In some embodiments consistent with FIG. 6, a value for $KD_1$ may be obtained from a multiple programmable distance register control. In some embodiments consistent with FIG. 6, a value for $KD_1$ may be obtained from a multiple programmable percent register control. In a multiple programmable percent register control a percent value P may be obtained from the register and the value of $KD_1$ may obtained as $KD_1=(P/100)\times RL_{in}$. A lookup table including at least one programmable distance register control, and at least a multiple programmable percent register control may be stored in a memory chip. The memory chip may be accessible by controller 140 and by LC controller 140. The memory chip may be included in LCD system 100 according to some embodiments. In some embodiments, the memory chip may be external to LCD system 100 and may be accessible by LCD 100.

According to embodiments consistent with FIG. 2, point A in step 639 may be assigned coordinates ($KL_{in}$, $KL_{out}$) given by the following expressions ($m_d=1$)

$$KL_{in} = RL_{in} - f(RL_{in}), \tag{21}$$

and $$KL_{out} = \left(\frac{1}{DR}\right)\cdot KL_{in} = \left(\frac{1}{DR}\right)\cdot (RL_{in} - f(RL_{in})). \tag{22}$$

Where $f(RL_1)$ may be any assignment of a value for $KD_1$ (cf. FIG. 2) based on the value of $RL_{in}$ obtained in step 620. For example, $f(RL_{in})$ may be a tabulated function obtained from a multiple programmable register control or a multiple programmable percent register control, as described above. For example, if pixel width is 6 bits, then RI=63 and the percent value P for $f(RL_{in})$ may be P=10 (or 10% 'soft clipping range'). Thus, a table as used in step 639 according some embodiments of the method depicted in FIG. 6 may contain the following entries: If dimming factor 240 is 50%, then $RL_{in}=32$, $KD_1=3$ (~10%×32), and $KL_{in}=32-3=29$; if dimming factor 240 is 80%, then $RL_{in}=50$, $KD_1=5$ (=10%×50), and $KL_{in}=50-5=45$; if dimming factor 240 is 95%, then $RL_{in}=60$, $KD_1=6$ (~10%×60), and $KL_{in}=60-6=54$.

In step 639 soft clip portion 220 may be established by joining points A 260 and C 262 by a straight line segment, according to embodiments consistent with FIG. 2. In step 639, the precise location of point C may be found with coordinates ($RL_{in}+KD_2$, RO). The value of knee distance $KD_2$ may be obtained following different criteria, consistent with the embodiments illustrated in FIGS. 2-5. For example, some embodiments may obtain the value of $KD_2$ in step 639 by using a pre-selected value for slope $m_{sc}$ 252 (cf. FIG. 2). In some embodiments, slope $m_{sc}$ 252 may be chosen to be $m_{sc}=(½)\times m_d$; for example, $m_{sc}$ may be equal to 0.5 in embodiments where $m_d=1$. In such cases the value for $KD_2$ may be given by the following expression $$KD_2 = \left(\frac{RO - KL_{out}}{m_{sc}}\right) - KD_1. \tag{23}$$

Where $KD_2$ may be obtained from Eq. (22) in step 639. In some embodiments a value of $KD_2$ may be set equal to the value of $KD_1$. Thus, in the examples listed above for a 6-bit pixel width and P=10%, the following soft clipping regions may result: If dimming factor 240 is 50%, then $KL_{in}=32-3=29$, $HC_{in}=32+3=35$, and soft clip portion is (29, 35); if dimming factor 240 is 80%, then $KL_{in}=50-5=45$, $HC_{in}=50+5=55$, and soft clip portion is (45, 55); if dimming factor 240 is 95%, then $KL_{in}=60-6=54$, $HC_{in}=60+6=66$. In the latter case, $HC_{in}=66$ may be beyond RI (RI=63 according to above), therefore soft clip portion may be (54, 63), there is no hard clipping portion 230, and RO may not be fully used.

Some embodiments may obtain $KD_2$ in step 639 as a function of $RL_{in}$. For example, embodiments consistent with FIG. 5 may obtain $KD_2$ as a percent fraction of $RL_{in}$. Furthermore, the value of $KD_2$ may be obtained as a function $g(RL_{in})$, where the value of the function $g(RL_{in})$ may be retrieved from a lookup table, a multiple programmable distance register control, or a multiple programmable percent register control.

In step 640 a code conversion chart is prepared using the dimming ratio obtained in step 610, a knee point A and a soft clip portion as obtained in step 630. In some embodiments, a code conversion chart consistent with chart 200 in FIG. 2 may be provided in step 640, having knee point A 260, soft clip portion 220, hard clip C 262, and hard clip portion 230. The code conversion chart may be prepared by LC panel controller 140, and provided to LC panel 160 in order to display an image. In some embodiments the code conversion chart may be prepared by controller 120 and provided to LC controller 140. LC controller 140 may in turn provide $CV_{out}$ values 102 to LC panel 160, according to the code conversion chart.

Embodiments of the invention described above are exemplary only. One skilled in the art may recognize various alternative embodiments from those specifically disclosed. Those alternative embodiments are also intended to be within the scope of this disclosure. As such, the invention is limited only by the following claims.

What is claimed is:

1. A liquid crystal display (LCD) system comprising:
- a liquid crystal (LC) panel;
- an LC panel controller configured to send output code values to the LC panel;
- a backlight configured to illuminate the LC panel;
- a backlight controller configured to control the backlight; and
- a display controller configured to control the backlight controller and the LC panel controller and receive input code values from an image source,
- wherein the LCD system uses a dynamic knee point determination of soft clipping to provide output code values to the LC panel by:
  - obtaining a hard clip reference point using a backlight dimming ratio; and
  - selecting the dynamic knee point and a soft clip portion using the hard clip reference point by:
    - obtaining a first knee distance corresponding to a distance of input code values between the dynamic knee point and the hard clip reference point; and
    - obtaining a second knee distance corresponding to a distance of input code values between the hard clip reference point and a hard clip point where the soft clip portion ends.

2. An LCD system as in claim 1 further comprising a memory chip to store a lookup table for use by the LCD system in the dynamic knee point determination of soft clipping to provide output code values to the LC panel.

3. The LCD system of claim 1, wherein the second knee distance is equal to the first knee distance.

4. The LCD system of claim 1, wherein the backlight dimming ratio is 0.5.

5. A method for using an LCD system to provide an input to output code value conversion comprising:

using a backlight dimming ratio to provide a dynamic knee point for soft clipping the input to output code value conversion by:

obtaining a hard clip reference point using the backlight dimming ratio; and selecting the dynamic knee point and a soft clip portion using the hard clip reference point by:

obtaining a first knee distance corresponding to a distance of input code values between the dynamic knee point and the hard clip reference point; and obtaining a second knee distance corresponding to a distance of input code values between the hard clip reference point and a hard clip point where the soft clip portion ends.

6. The method of claim 5 wherein the first knee distance is obtained from a register, and wherein the second knee distance is equal to the first knee distance.

7. The method of claim wherein a first register provides the first knee distance and a second register provides the second knee distance.

8. The method of claim 5 wherein the LCD system comprises a display controller and an LC panel controller; and further wherein the step of using the backlight dimming ratio to provide the dynamic knee point for soft clipping the input to output code value conversion is performed by the display controller.

9. The method of claim 5 wherein the LCD system comprises a display controller and an LC panel controller; and further wherein the step of using the backlight dimming ratio to provide the dynamic knee point for soft clipping the input to output code value conversion is performed by the LC panel controller.

10. The method of claim 5 wherein the LCD system comprises a display controller and an LC panel controller; and further wherein at least one step is performed by the display controller and at least one step is performed by the LC panel controller.

11. The method of claim 5, wherein the backlight dimming ratio is 0.5.

12. A method for using an LCD system to provide an input to output code value conversion comprising:

using a backlight dimming ratio to provide a dynamic knee point for soft clipping the input to output code value conversion, wherein:

the dynamic knee point is determined dynamically as a function of a hard clip reference point minus a first knee distance;

the hard clip reference point is determined by the backlight dimming ratio;

the soft clipping ends at a hard clip point; and the hard clip point is determined dynamically as a function of the hard clip reference point plus a second knee distance.

13. The method of claim 12, wherein the second knee distance is equal to the first knee distance.

14. The method of claim 12, wherein the backlight dimming ratio is 0.5.

15. A method for using an LCD system to provide an input to output code value conversion comprising:

using a backlight dimming ratio to provide a dynamic knee point for soft clipping the input to output code value conversion by:

obtaining a hard clip reference point using the backlight dimming ratio;

selecting the dynamic knee point and a soft clip portion using the hard clip reference point by:

obtaining, from a percentage register, a percentage value;

selecting a first knee distance as the percentage value of the input value of the hard clip reference point, wherein the first knee distance corresponds to a distance of input code values between the dynamic knee point and the hard clip reference point; and setting a second knee distance equal to the first knee distance, wherein the second knee distance corresponding to a distance of input code values between the hard clip reference point and a hard clip point where the soft clip portion ends.

16. The method of claim 15, wherein the backlight dimming ratio is 0.5.

17. A method for using an LCD system to provide an input to output code value conversion comprising:

using a backlight dimming ratio to provide a dynamic knee point for soft clipping the input to output code value conversion by:

obtaining a hard clip reference point using the backlight dimming ratio;

selecting the dynamic knee point and a soft clip portion using the hard clip reference point by:

obtaining, from a first percentage register, a first percentage value;

obtaining, from a second percentage register, a second percentage value;

selecting a first knee distance as the first percentage value of the input value of the hard clip reference point, wherein the first knee distance corresponds to a distance of input code values between the dynamic knee point and the hard clip reference point; and selecting a second knee distance as the second percentage value of the input value of the hard clip reference point, wherein the second knee distance corresponding to a distance of input code values between the hard clip reference point and a hard clip point where the soft clip portion ends.

18. The method of claim 17, wherein the second knee distance is equal to the first knee distance.

19. The method of claim 17, wherein the backlight dimming ratio is 0.5.

* * * * *